US009990892B2

(12) United States Patent
Chen et al.

(10) Patent No.: US 9,990,892 B2
(45) Date of Patent: Jun. 5, 2018

(54) LIQUID CRYSTAL PANEL AND DRIVING METHOD THEREOF

(71) Applicant: Shenzhen China Star Optoelectronics Technology Co., Ltd., Guangdong (CN)

(72) Inventors: Lixuan Chen, Guangdong (CN); Chih-tsung Kang, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 68 days.

(21) Appl. No.: 14/781,133

(22) PCT Filed: Aug. 12, 2015

(86) PCT No.: PCT/CN2015/086786

§ 371 (c)(1),
(2) Date: Sep. 29, 2015

(87) PCT Pub. No.: WO2016/197450

PCT Pub. Date: Dec. 15, 2016

(65) Prior Publication Data

US 2017/0148396 A1 May 25, 2017

(30) Foreign Application Priority Data

Jun. 12, 2015 (CN) ..... 2015 1 0326020

(51) Int. Cl.
*G09G 3/36* (2006.01)
*G09G 3/20* (2006.01)

(52) U.S. Cl.
CPC ..... *G09G 3/3607* (2013.01); *G09G 3/2003* (2013.01); *G09G 2300/0443* (2013.01);
(Continued)

(58) Field of Classification Search
CPC ..... G09G 3/3607; G09G 3/2003; G09G 2300/0443; G09G 2300/0452;
(Continued)

(56) References Cited

U.S. PATENT DOCUMENTS

2003/0016199 A1* 1/2003 Lee ..... G09G 3/3607 345/88
2003/0058202 A1* 3/2003 Evanicky ..... G09G 3/006 345/82

(Continued)

FOREIGN PATENT DOCUMENTS

CN 1821842 8/2006
CN 104155813 11/2014

(Continued)

OTHER PUBLICATIONS

International Search Report for PCT/CN2015/086786, English Translation attached to original, Both completed by the Chinese Patent Office dated Jan. 8, 2016, All together 6 Pages.

*Primary Examiner* — Sejoon Ahn
(74) *Attorney, Agent, or Firm* — Mintz Levin Cohn Ferris Glovsky and Popeo, P.C.; Kongsik Kim

(57) ABSTRACT

A liquid crystal panel including a plurality of pixel units, each including sub-pixel units of a plurality of colors, the sub-pixel units included in the liquid crystal panel includes a main pixel area and a secondary pixel area. The driving method includes: acquiring a grayscale value of a picture to be displayed of each of the partial sub-pixel units; searching for a main grayscale value and a secondary grayscale value corresponding to the grayscale value of the picture to be displayed of the each of the partial sub-pixel units from a corresponding relationship between grayscale values of a color of each of the partial sub-pixel units and the main grayscale values and the secondary grayscale values; and providing the searched main grayscale value and the secondary grayscale value to areas of the main pixel unit and the secondary pixel unit of the each of the partial sub-pixel units respectively.

9 Claims, 4 Drawing Sheets

(52) U.S. Cl.
CPC ..... *G09G 2300/0452* (2013.01); *G09G 2320/0242* (2013.01); *G09G 2320/0633* (2013.01); *G09G 2320/0673* (2013.01)

(58) Field of Classification Search
CPC ... G09G 2320/0242; G09G 2320/0633; G09G 2320/0673
See application file for complete search history.

(56) References Cited

U.S. PATENT DOCUMENTS

| | | | | |
|---|---|---|---|---|
| 2007/0058115 | A1* | 3/2007 | Utsumi | G02F 1/133514 349/109 |
| 2007/0064190 | A1* | 3/2007 | Kim | G02F 1/1345 349/142 |
| 2008/0036718 | A1* | 2/2008 | Lee | G09G 3/3607 345/88 |
| 2008/0042956 | A1* | 2/2008 | Hur | G02F 1/133707 345/92 |
| 2013/0256707 | A1* | 10/2013 | Chiang | H01L 33/08 257/88 |
| 2015/0332648 | A1 | 11/2015 | Tien et al. | |
| 2016/0246108 | A1 | 8/2016 | Hsu et al. | |
| 2016/0247296 | A1 | 8/2016 | Chen | |
| 2016/0253949 | A1 | 9/2016 | Chen | |

FOREIGN PATENT DOCUMENTS

| | | |
|---|---|---|
| CN | 104166258 | 11/2014 |
| CN | 104167194 | 11/2014 |
| CN | 104460077 | 3/2015 |

* cited by examiner

LIQUID CRYSTAL PANEL AND DRIVING METHOD THEREOF

CROSS-REFERENCE TO RELATED APPLICATION

This application is the U.S. national phase of PCT Application No. PCT/CN2015/086786 filed on Aug. 12, 2015, which claims priority to CN Patent Application No. 201510326020.2 filed on Jun. 12, 2015, the disclosures of which are incorporated in their entirety by reference herein.

TECHNICAL FIELD

The present invention generally relates to a technical field of a liquid crystal display, and more particularly to a liquid crystal panel and a driving method thereof.

BACKGROUND ART

A liquid crystal display (LCD) is a flat and ultra-thin display apparatus, which is composed of a certain amount of color or black-and-white pixels and disposed in front of a light source or a reflection plate. Power consumption of the liquid crystal display is very low, and the liquid crystal display has characteristics such as high image quality, small volume and low weight, which is accordingly highly appreciated and becomes a mainstream of displays. The liquid crystal display has been widely applied to electronic products, such as a computer apparatus, a mobile phone or a digital photo frame having a display screen etc., and a wide view angle technology is one of the development emphases of current liquid crystal displays. However, when a side view angle or a slant view angle is excessively large, a color shift phenomenon generally occurs in a wide view angle liquid crystal display.

As for a problem that color shift occurs in a wide view angle liquid crystal display, a 2D1G technology is adopted in current industry to solve the problem. The so-called 2D1G technology indicates that each of pixel units is divided into a main pixel area and a sub pixel area having different areas in a liquid crystal panel, the main pixel area and the sub pixel area in the same one pixel unit are connected to different data lines and same gate lines. Different display luminance and slant view luminance are generated through inputting different data signals (different grayscale values) to the main pixel area and the sub pixel area so as to reduce color shift generated during side viewing or slant viewing. However, after each pixel unit is divided into the main pixel area and the sub pixel area, a number of the data lines for inputting data signals will be twice the original number, which may greatly reduce open ratio of the liquid crystal panel, affect penetration rate, and reduce display quality of the liquid display panel.

SUMMARY

To this end, the purpose of the present invention is to provide a liquid crystal panel and a driving method thereof, color shift during side viewing or slant viewing is reduced by changing the driving method of the liquid crystal panel so as to reduce effect on penetration rate. In addition, the problem that skin color is slanted to yellow and green produced by simply dividing the entire blue sub pixel units into main pixel areas and sub pixel areas is also overcome.

According to one aspect of an exemplary embodiment of the present invention, a driving method of a liquid crystal panel is provided, the liquid crystal panel including a plurality of pixel units, wherein, each of the pixel units comprises sub pixel units of a plurality of colors, wherein, each of partial sub pixel units among sub pixel units of a part or all of the plurality of colors among all sub pixel units included in the liquid crystal panel includes a main pixel area and a secondary pixel area, the driving method comprises: acquiring a grayscale value of a picture to be displayed of each of the partial sub pixel units; searching for a main grayscale value and a secondary grayscale value corresponding to the grayscale value of the picture to be displayed of the each of the partial sub pixel units from a corresponding relationship between grayscale values of a color of each of the partial sub pixel units and the main grayscale values and the secondary grayscale values; and providing the searched main grayscale value and the secondary grayscale value to areas of the main pixel unit and the secondary pixel unit of the each of the partial sub pixel units respectively.

Each of all sub pixel units in partial pixel units may include the main pixel area and the secondary pixel area, and all the sub pixel units in the other partial pixel units do not include the main pixel area and the secondary pixel area.

The sub pixel units in the partial pixel units may be not adjacent.

The corresponding relationship between the grayscale values of each of the colors and the main grayscale values and the secondary grayscale values may satisfy the following conditions: in an order of magnitudes of the grayscale values of any one color, respectively providing the main grayscale values and the secondary grayscale values corresponding to the grayscale values to the main pixel areas and the secondary pixel areas of the sub pixel units of the any one color among the partial sub pixel units in sequence, and a relation curve graph between the grayscale values and luminances of the sub pixel units of the any one color at the slant angle β is same as or similar to a predetermined gamma (γ) curve.

The corresponding relationship between the grayscale values of the any one color and the main grayscale values and secondary grayscale values may be acquired from the following steps:

S101, acquiring an actual luminance value Lvα of each grayscale G of a sub pixel unit of the any one color of the liquid crystal panel at a front view angle α;

S102, acquiring an actual luminance value Lvβ of each grayscale G of the sub pixel unit of the any one color of the liquid crystal panel at a slant view angle β;

S103, according to an area ratio of a:b of the main pixel area and the secondary pixel area of the sub pixel unit of the any one color, dividing the actual luminance value Lvα into actual values LvMα and LvSβ of each grayscale G of the main pixel area and the secondary pixel area at the front view angle α, dividing the actual luminance value Lvβ into actual values LvMβ and LvSβ of each grayscale G of the main pixel area and the secondary pixel area at the slant view angle β according to the following equations:

$$LvM\alpha: LvS\alpha=a:b,\ LvM\alpha+LvS\alpha=Lv\alpha;$$

$$LvM\beta: LvS\beta=a:b,\ LvM\beta+LvS\beta=Lv\beta;$$

S104: calculating theoretical luminance values LvGxα and LvGxβ of the gray scale G of the sub pixel unit of the any one color of the liquid crystal panel at the front view angle α and the slant angle β according to the actual luminance values Lvα(max) and Lvβ(max) of a highest grayscale max acquired in steps S101 and S102, in conjunction with a equation of the predetermined gamma (γ) curve and $$\left(\frac{G}{\max}\right)^{\gamma} = \frac{LvG}{Lv(\max)};$$

S105, determining the main grayscale value and the secondary value corresponding to each of grayscale values of the any one color, wherein, as for any one grayscale value Gx, following equations are calculated according to the actual luminance values LvMα, LvMβ, LvSα and LvSβ obtained in the result of the above step S103 and the theoretical luminance values LvGxα and LvGxβ obtained in the result of the above step S104:

$$\Delta 1 = LvM\alpha + LvS\alpha - LvGx\alpha;\ \Delta 2 = LvM\beta + LvS\beta - LvGx\beta;$$
$$\gamma = \Delta 1^2 + \Delta 2^2;$$

when y is minimal, corresponding grayscale values Gmx and Gsx are set to be the main grayscale value and the secondary grayscale value corresponding to the any one grayscale value Gx.

The step S101 may comprise:

measuring the gamma (γ) curve of the sub pixel unit of the any one color at the front view angle α directly; and determining the actual luminance value Lvα according to the gamma (γ) curve.

The step S102 may comprise:

measuring the gamma (γ) curve of the sub pixel unit of the any one color at the slant view angle β directly; and determining the actual luminance value Lvβ according to the gamma (γ) curve.

The front view angle α may be 0°, and the squint angle β may be 30°-80°.

According to another aspect of an exemplary embodiment of the present invention, it is provided a liquid crystal panel, comprising a gate controller, a source controller and a plurality of pixel units, each of the pixel units comprising sub pixel units of a plurality of colors, wherein, each of partial sub pixel units among sub pixel units of a part or all of the plurality of colors among all sub pixel units included in the liquid crystal panel includes a main pixel area and a secondary pixel area; as for any one sub pixel unit in the partial sub pixel units, the gate controller provides scanning signals to the main pixel area and the secondary pixel area of the any one sub pixel unit through the same scanning line, and the source controller provides data signals to the main pixel area and the secondary pixel area of the any one sub pixel unit through different data lines.

According to the liquid crystal panel and the driving method thereof provided by the exemplary embodiment, partial sub pixel units in a traditional RGB three-pixel liquid crystal panel is set to include two different main pixel area and secondary pixel area, data parameters are re-set, the main pixel area and the secondary pixel area are connected to data signal lines respectively, and different grayscale values are input to the main pixel area and the secondary pixel area, so as to solve color shift problem generated in a case of a wide view, and reduce effect on penetration rate; moreover, the problem that skin color is slanted to yellow and green produced by simply setting the entire blue sub pixel units to include main pixel area and sub pixel area is also overcome.

BRIEF DESCRIPTION OF THE DRAWINGS

The above and other targets, features and advantages of exemplary embodiments of the present invention will become apparent from the following detailed description, taken in conjunction with the accompanying drawings in which.

DETAILED DESCRIPTION OF EXEMPLARY EMBODIMENTS

Figure 1:
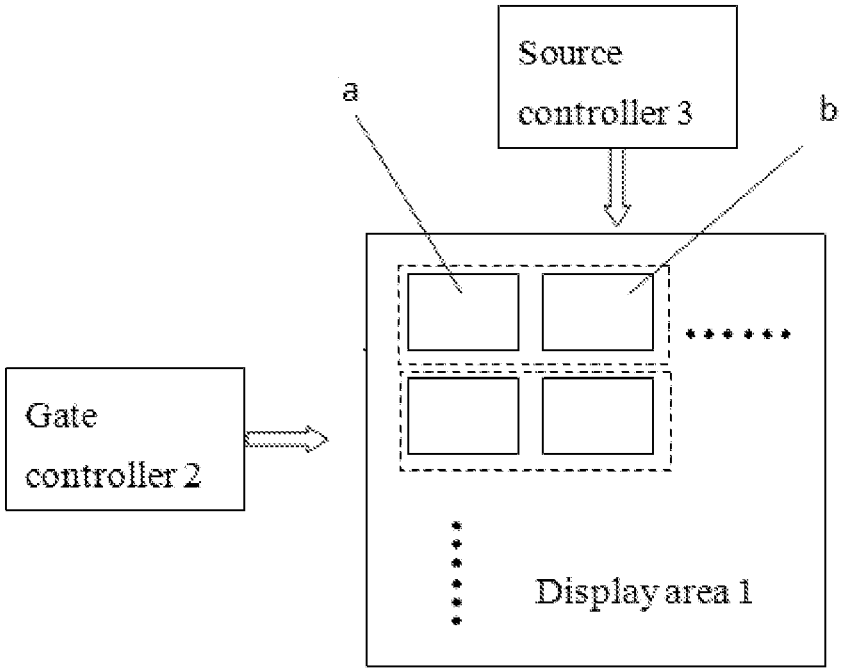
FIG. 1 is a structure diagram of a liquid crystal panel according to an exemplary embodiment of the present invention.

Here a detailed reference will be made to exemplary embodiments of the present invention, in which the examples are shown in the drawings and the same drawing reference marks always indicate the same component. Embodiments of the present invention will be described in detail below by referring to the accompany drawings.

FIG. 1 is a structure diagram of a liquid crystal panel according to an exemplary embodiment of the present invention. As shown in FIG. 1, a liquid crystal panel mainly includes a display area 1 having a plurality of pixel units a and b, a gate controller 2 and a source controller 3, wherein the gate controller 2 provides scanning signals to the pixel units a and b through a plurality of scanning lines, and the source controller 3 provides data signals to the pixel units a and b through a plurality of data lines.

Figure 2:
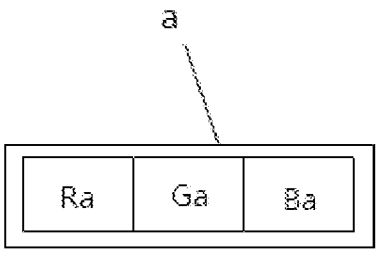
FIG. 2 is a structure diagram of a pixel unit in the liquid crystal panel according to an exemplary embodiment of the present invention.

Each of the pixel units includes sub pixel units of a plurality of colors. Among all the sub pixel units included in the liquid crystal panel, each of partial sub pixel units among (i.e. each of a part of) the sub pixel units of partial colors or all colors include a main pixel area and a secondary pixel area; as for any one sub pixel unit among the partial sub pixel units, the gate controller provides scanning signals to the main pixel area and the secondary pixel area of the any one sub pixel unit through the same scanning line, and the source controller provides data signals to the main pixel area and the secondary pixel area of the any one sub pixel unit through different data lines. Here, each pixel unit can include at least one of following units: a red sub pixel unit, a green sub pixel unit, a blue sub pixel unit and sub pixel units of other colors. As shown in the diagram of a pixel unit in the liquid crystal panel according to an exemplary embodiment of the present invention shown in FIG. 2, each pixel unit a can include a red sub pixel unit Ra, a green sub pixel unit Ga and a blue sub pixel unit Ba.

Figure 3:
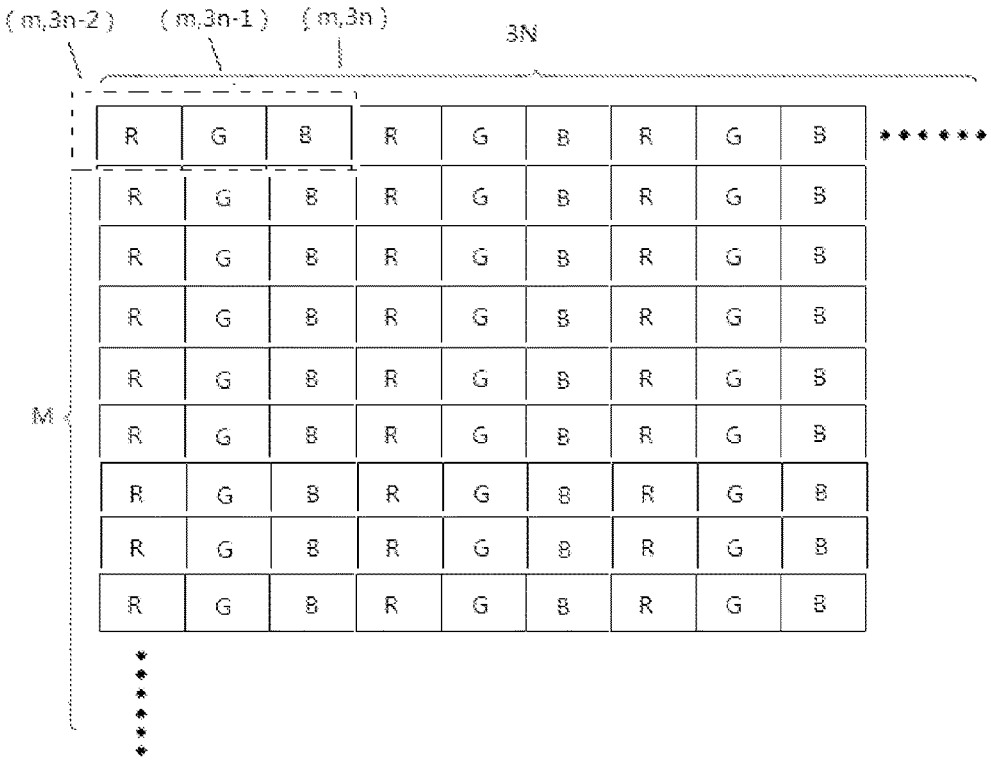
FIG. 3 is a diagram of an array of sub pixel units in a liquid crystal panel according to an exemplary embodiment of the present invention.

FIG. 3 is a diagram of an array of sub pixel units in a liquid crystal panel according to an exemplary embodiment of the present invention. As shown in FIG. 3, the liquid crystal panel includes pixel units of M (line)×N (column), wherein, M and N are positive integers greater than 1, each pixel unit is composed of the red sub pixel unit, the green sub pixel unit and the blue sub pixel unit, and the liquid crystal panel includes an array of sub pixel units of M (line)×3N (column). In the array of the sub pixel units, the (m, 3n−2)-th sub pixel unit indicates a red sub pixel unit R, the (m, 3n−1)-th sub pixel unit indicates a green sub pixel unit G, the (m, 3n)-th sub pixel unit indicates a blue sub pixel unit B, wherein m∈[1, 2, 3, . . . , M], and n∈[1, 2, 3, . . . , N].

Here, the partial sub pixel units among the sub pixel units of the partial colors or the all colors indicate partial sub pixel units among the sub pixel units of each of the partial colors or the all colors, which can solve the problem that skin color is slanted to yellow and green produced by simply setting the entire blue sub pixel units to include main pixel units and sub pixel units. For example, in the case where the partial colors are red and blue, the partial sub pixel units among the sub pixel units of the partial colors include partial sub pixel units among the red sub pixel units and partial sub pixel units among the blue sub pixel units. Here, the main pixel area and the secondary pixel area included in the partial sub pixel units can be formed through a division in a form of black matrix, and also can formed through a division by opaque metal wires.

Figure 4:
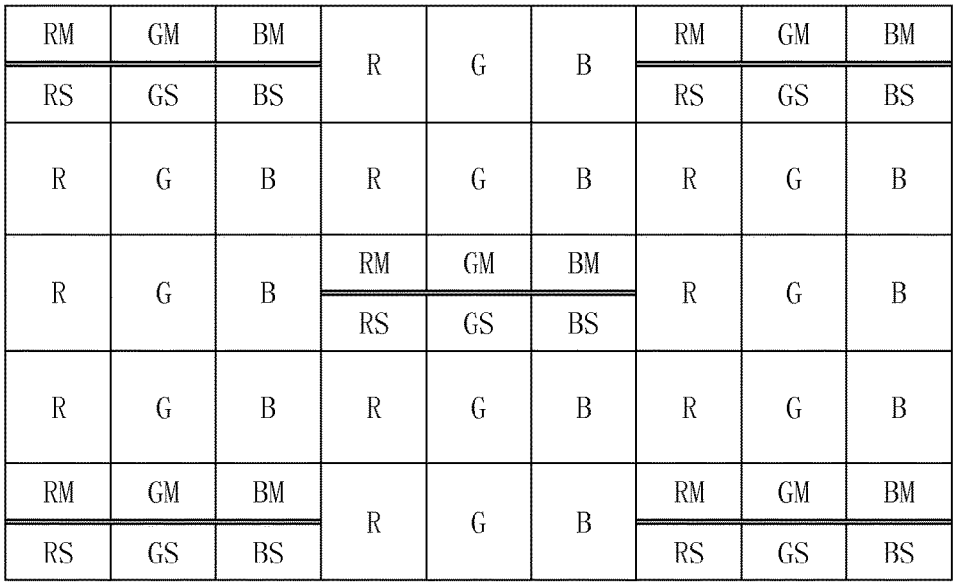
FIG. 4 is a diagram of a combination of partial sub pixel units according to an exemplary embodiment of the present invention.

A combination of the above partial sub pixel units may have many forms. FIG. 4 is a diagram of a combination of the divided partial sub pixel units according to an exemplary embodiment of the present invention. As shown in FIG. 4, partial sub pixel units among the red sub pixel units include a main pixel area RM and a red secondary pixel area RS, partial sub pixel units among the blue sub pixel units include a main pixel area BM and a secondary pixel area BS, and partial sub pixel units among the green sub pixel units are divided into a main pixel area GM and a secondary pixel area GS. The sub pixel units of the various colors among the partial sub pixel units are mutually combined to constitute a plurality of pixel units. That is to say, any one sub pixel unit among the sub pixel units of any one color among the partial sub pixel units and the sub pixel unit among the sub pixel units of other colors among the partial sub pixel units constitute a pixel unit. That is to say, all the sub pixel units in the partial pixel units (which include the red sub pixel unit, the green sub pixel unit and the blue sub pixel unit) include the main pixel unit and the secondary pixel unit, and all the sub pixel units in the other pixel units do not include the main pixel unit and the secondary pixel unit. As shown in FIG. 4, the partial pixel units are not adjacent, so as to solve the problems of penetration rate and color shift. Those skilled in the art can understand that the combination of the divided partial sub pixel units according to an exemplary embodiment of the present invention is not limited to the form shown in FIG. 4.

Figure 5:
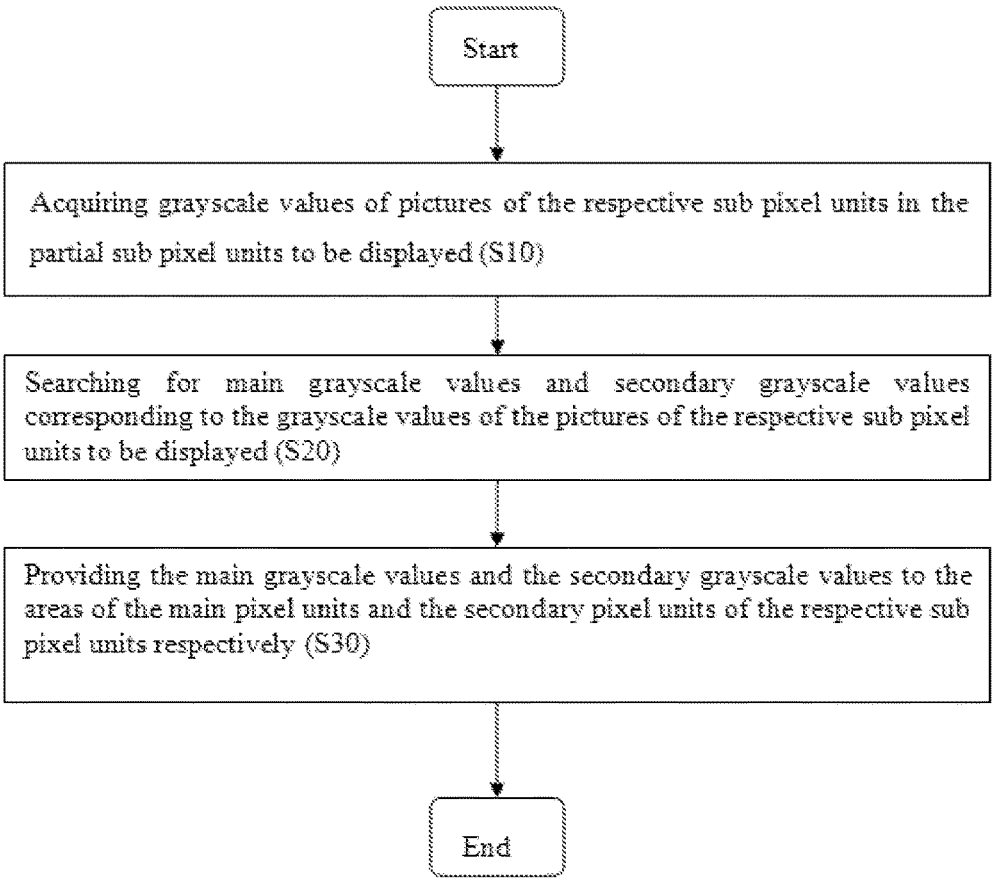
FIG. 5 is a flowchart of a driving method of a liquid crystal panel according to an exemplary embodiment of the present invention.

FIG. 5 is a flowchart of a driving method of a liquid crystal panel according to an exemplary embodiment of the present invention.

Referring to FIG. 5, in step S10, a grayscale value of a picture to be displayed of each of the partial sub pixel units is acquired.

In step S20, a main grayscale value and a secondary grayscale value corresponding to the grayscale value of the picture to be displayed of each of the partial sub pixel units are searched from a corresponding relationship between grayscale values of a color of each of the partial sub pixel units and the main grayscale values and the secondary grayscale values. That is to say, as for a sub pixel unit of any one color, the main grayscale value and the secondary grayscale value corresponding to the grayscale value of the picture to be displayed of the sub pixel unit are searched from the corresponding relationship between the grayscale values of the any one color and the main grayscale values and the secondary grayscale values.

Here, the corresponding relationship between the grayscale values of each of the colors and the main grayscale values and the secondary grayscale values satisfy the following conditions: in an order of magnitudes of the grayscale values of any one color, respectively providing the main grayscale values and the secondary grayscale values corresponding to the grayscale values to the main pixel areas and the secondary pixel areas of the sub pixel units of the any one color among the partial sub pixel units in sequence, and a relation curve graph between the grayscale values and luminances of the sub pixel units of the any one color at the slant angle β is same as or similar to a predetermined gamma (γ) curve.

Here, the Gamma (γ) curve can be determined according to a practical requirement of the liquid crystal panel, and a value range of γ may be 1.8 to 2.4. A range of the slant view angle β is 30° to 80°.

Below, a step of obtaining a corresponding relationship between a blue grayscale value and a main grayscale value and a secondary grayscale value will be taken as an example in conjunction with FIG. 6 to explain the step of obtaining the corresponding relationship between the grayscale value and the main grayscale value and the secondary grayscale value of the respective colors in detail.

Figure 6:
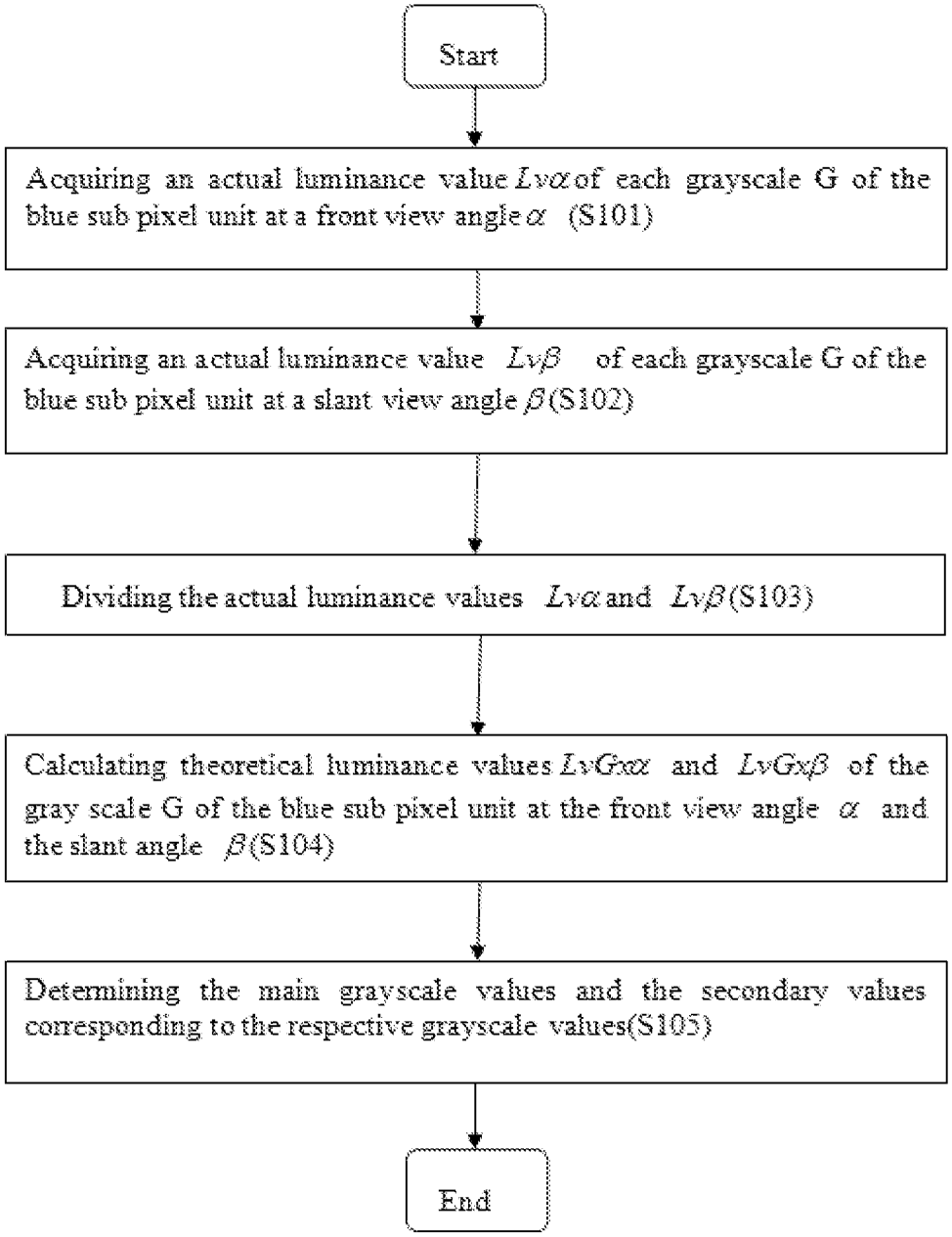
FIG. 6 is a flowchart of a step of obtaining a corresponding relationship between a blue grayscale value and a main grayscale value and a secondary grayscale value according to an exemplary embodiment of the present invention.

FIG. 6 is a flowchart of a step of obtaining a corresponding relationship between a blue grayscale value and a main grayscale value and a secondary grayscale value according to an exemplary embodiment of the present invention.

Referring to FIG. 6, in step S101, an actual luminance value Lvα of each grayscale G of the blue sub pixel unit of the liquid crystal panel at a front view angle α is acquired. Here, the front view α may be 0°. Wherein, the grayscale of the liquid crystal panel includes 256 grayscale values from 0 to 255. In step S101, the actual luminance value Lvα may be acquired through various proper manners. For example, a gamma (γ) curve of the blue sub pixel unit at the front view angle α is directly measured and the actual luminance value Lvα can be determined from the gamma (γ) curve.

In step S102, an actual luminance value Lvβ of each grayscale G of the blue sub pixel unit of the liquid crystal panel at a slant view angle β is acquired. In step S102, the actual luminance value Lvβ may be acquired through various proper manners. For example, a gamma (γ) curve of the blue sub pixel unit at the front view angle β is directly measured and the actual luminance value Lvβ may be determined from the gamma (γ) curve.

In step S103, according to an area ratio of a:b of the main pixel area and the secondary pixel area of the blue sub pixel unit, the actual luminance values Lvα and Lvβ are divided according to following equations, that is to say, the actual luminance value Lvα is divided into actual values LvMα and LvSβ of each grayscale G of the main pixel area and the secondary pixel area at the front view angle α, and the actual luminance value Lvβ is divided into actual values LvMβ and LvSβ of each grayscale G of the main pixel area and the secondary pixel area at the slant view angle β according to the following equations:

$$LvM\alpha: LvS\alpha=a:b,\ LvM\alpha+LvS\alpha=Lv\alpha;$$

$$LvM\beta: LvS\beta=a:b,\ LvM\beta+LvS\beta=Lv\beta;$$

In step S104, theoretical luminance values LvGxα and LvGxβ of the gray scale G of the blue sub pixel unit of the liquid crystal panel at the front view angle α and the slant angle β are calculated according to the actual luminance values LvαB(max) and LvβB(max) of a highest grayscale max acquired in steps S101 and S102, in conjunction with a equation of the predetermined gamma (γ) curve and $$\left(\frac{G}{\max}\right)^{\gamma} = \frac{LvG}{Lv(\max)}.$$

In step S105, the main grayscale value and the secondary value corresponding to the respective blue grayscale values are determined, wherein, as for any one grayscale value Gx, following equations are calculated according to the actual luminance values LvMα, LvMβ, LvSα and LvSβ obtained in the result of the above step S103 and the theoretical luminance values LvGxα and LvGxβ obtained in the result of the above step S104:

$$\Delta 1 = LvM\alpha + LvS\alpha - LvGx\alpha;\ \Delta 2 = LvM\beta + LvS\beta - LvGx\beta;$$
$$y = \Delta 1^2 + \Delta 2^2;$$

Corresponding grayscale values Gmx and Gsx, when y is minimal, are set to be the main grayscale value and the secondary grayscale value corresponding to the any one grayscale value Gx, respectively.

In addition, based on the same manner, the corresponding relationships between the grayscale values of the other colors and the main grayscale values and the secondary grayscale values are acquired, which will be omitted herein.

Those skilled in the art will understand that, the manner of acquiring the above corresponding relationship is not limited to the manner shown in FIG. 6, and the above corresponding relationship also can be acquired through the other proper manners.

Referring to FIG. 5 again, in step S30, the searched main grayscale values and secondary grayscale values are provided to the areas of the main pixel units and the secondary pixel units of the respective sub pixel units respectively. That is to say, the main grayscale values and the secondary grayscale values corresponding to the grayscale values of the pictures to be displayed of the respective sub pixel units are provided to the areas of the main pixel units and the secondary pixel units of the respective sub pixel units among partial sub pixel units respectively.

Those skilled in the art will understand that, the other sub pixel units which do not include the main pixel unit and the secondary unit in the liquid crystal panel may be driven according to the driving methods in the prior art, that is, the grayscale values of the pictures to be displayed of the sub pixel units are provided to the sub pixel units.

According to the liquid crystal panel and the driving method thereof provided by the exemplary embodiment, partial sub pixel units in a traditional RGB three-pixel liquid crystal panel is configured to include two different main pixel area and secondary pixel area, data parameters are re-set, the main pixel area and the secondary pixel area are connected to data signal lines respectively, and different grayscale values are input to the main pixel area and the secondary pixel area, so as to solve color shift problem generated in a case of a wide view, and reduce effect on penetration rate; moreover, the problem that skin color is slanted to yellow and green produced by simply configuring the all blue sub pixel units to include main pixel area and sub pixel area is also overcome.

In addition, it should be understood that, the driving method of the liquid crystal panel according to the exemplary embodiment of the present invention may be embodied as computer readable codes on a computer readable recording medium. The computer readable recording medium is any data storage device that can store data which can be thereafter read by a computer system. Examples of the computer readable recording medium include: a Read-Only Memory (ROM), a Random-Access Memory (RAM), a CD-ROM, a magnetic tape, a floppy disk, an optical data storage device and a carrier wave (such as a data transmission passing through a network via a wired or wireless transmission path). The computer readable recording medium also can be distributed in the computer system that is connected to the network, so that the computer readable codes are stored and performed in a distribution manner. In addition, function programs, codes and code segments implementing the present invention may be easily construed by ordinary programmers in the field related to the present invention within the range of the present invention.

Although the present invention has been particularly shown and described with reference to exemplary embodiments thereof, it will be understood by those skilled in the art that various changes in forms and details may be made therein without departing from the spirit and scope of the present invention as defined by the following claims.

The invention claimed is:

1. A driving method of a liquid crystal panel, the liquid crystal panel including a plurality of pixel units, wherein each of the pixel units includes sub pixel units of a plurality of colors, the driving method comprising:

providing the liquid crystal panel where a portion of the pixel units are partial pixel units, wherein each of the sub pixel units is a partial sub pixel unit which is divided into a main pixel area and a secondary pixel area, while the remaining portion of the pixel units are not partial pixel units;

acquiring a grayscale value of a picture to be displayed of each of the partial sub pixel units;

searching for a main grayscale value and a secondary grayscale value corresponding to the grayscale value of the picture to be displayed of the each of the partial sub pixel units from a corresponding relationship between the grayscale value of a color of each of the partial sub pixel units and the main grayscale value and the secondary grayscale value; and providing the searched main grayscale value and the secondary grayscale value to the main pixel area and the secondary pixel area of the each of the partial sub pixel units respectively;

wherein the partial pixel units including the partial sub pixel units are not adjacent to another partial pixel units including the partial sub pixel units;

wherein the corresponding relationship between the grayscale value of each of the colors and the main grayscale value and the secondary grayscale value satisfies the following conditions: in an order of magnitudes of the grayscale value of any one color from the plurality of colors, respectively providing the main grayscale value and the secondary grayscale value corresponding to the grayscale value to the main pixel area and the secondary pixel area of the sub pixel unit of the any one color among the partial sub pixel units in sequence, and a relation curve graph between the grayscale value and luminance of the sub pixel unit of the any one color at a slant angle (β) is same as or similar to a predetermined gamma (γ) curve.

2. A driving method of a liquid crystal panel, the liquid crystal panel including a plurality of pixel units, wherein each of the pixel units includes sub pixel units of a plurality of colors, the driving method comprises:

providing the liquid crystal panel where a portion of the pixel units are partial pixel units, wherein each of the sub pixel units is a partial sub pixel unit which is divided into a main pixel area and a secondary pixel area, while the remaining portion of the pixel units are not partial pixel units;

searching for a main grayscale value and a secondary grayscale value corresponding to the grayscale value of the picture to be displayed of the each of the partial sub pixel units from a corresponding relationship between the grayscale value of a color of each of the partial sub pixel units and the main grayscale value and the secondary grayscale value; and providing the searched main grayscale value and the secondary grayscale value to the main pixel area and the secondary pixel area of the each of the partial sub pixel units respectively;

wherein the corresponding relationship between the grayscale value of each of the colors and the main grayscale value and the secondary grayscale value satisfies the following conditions: in an order of magnitudes of the grayscale value of any one color from the plurality of colors, respectively providing the main grayscale value and the secondary grayscale value corresponding to the grayscale value to the main pixel area and the secondary pixel area of the sub pixel unit of the any one color among the partial sub pixel units in sequence, and a relation curve graph between the grayscale value and luminance of the sub pixel unit of the any one color at a slant angle (β) is same as or similar to a predetermined gamma (γ) curve; and wherein the corresponding relationship between the grayscale value of the any one color and the main grayscale value and the secondary grayscale value is acquired from the following steps:

S101, acquiring an actual luminance value Lvα of each grayscale G of a sub pixel unit of the any one color of the liquid crystal panel at a front view angle (α);

S102, acquiring an actual luminance value Lvβ of each grayscale G of the sub pixel unit of the any one color of the liquid crystal panel at the slant view angle (β);

S103, according to an area ratio of a:b of the main pixel area and the secondary pixel area of the sub pixel unit of the any one color, dividing the actual luminance value Lvα into actual values LvMα and LvSα of each grayscale G of the main pixel area and the secondary pixel area at the front view angle (α), dividing the actual luminance value Lvβ into actual values LvMβ and LvSβ of each grayscale G of the main pixel area and the secondary pixel area at the slant view angle (β) according to the following equations:

$$LvM\alpha: LvS\alpha=a:b,\ LvM\alpha+LvS\alpha=Lv\alpha;$$

$$LvM\beta: LvS\beta=a:b,\ LvM\beta+LvS\beta=Lv\beta;$$

S104: calculating theoretical luminance values LvGxα and LvGxβ of the grayscale G of the sub pixel unit of the any one color of the liquid crystal panel at the front view angle (α) and the slant angle (β) according to the actual luminance values Lvα(max) and Lvβ(max) of a highest grayscale max acquired in steps S101 and S102, in conjunction with an equation of the predetermined gamma (γ) curve and $$\left(\frac{G}{\max}\right)^{\gamma}=\frac{LvG}{Lv(\max)};$$

S105, determining the main grayscale value and the secondary value corresponding to each of the grayscale value of the any one color, wherein, as for any one grayscale value Gx, following equations are calculated according to the actual luminance values LvMα, LvMβ, LvSα and LvSβ obtained in the result of the above step S103 and the theoretical luminance values LvGxα and LvGxβ obtained in the result of the above step S104:

$$\Delta1=LvM\alpha+LvS\alpha-LvGx\alpha;\ \Delta2=LvM\beta+LvS\beta-LvGx\beta;\ y=\Delta1^2+\Delta2^2;$$

when y is minimal, corresponding grayscale values Gmx and Gsx are set to be the main grayscale value and the secondary grayscale value corresponding to the any one grayscale value Gx.

3. The driving method of claim 2, wherein the step S101 further comprises:

measuring the gamma (γ) curve of the sub pixel unit of the any one color at the front view angle (α) directly; and determining the actual luminance value Lvα according to the gamma (γ) curve.

4. The driving method of claim 2, wherein the step S102 further comprises:

measuring the gamma (γ) curve of the sub pixel unit of the any one color at the slant view angle (β) directly; and determining the actual luminance value Lvβ according to the gamma (γ) curve.

5. The driving method of claim 2, wherein the front view angle (α) is 0°, and the slant angle (β) is 30°-80°.

6. A method of driving a liquid crystal panel, the liquid crystal panel having a gate controller, a source controller and a plurality of pixel units, each of the pixel units including sub pixel units of a plurality of colors, wherein a portion of the pixel units are partial pixel units, wherein each of the sub pixel units is a partial sub pixel unit which is divided into a main pixel area and a secondary pixel area, while the remaining portion of the pixel units are not partial pixel units, the method comprising:

driving the liquid crystal panel, wherein, for any one sub pixel unit in the partial sub pixel units, the gate controller provides scanning signals to the main pixel area and the secondary pixel area of the any one sub pixel unit through a same scanning line, and the source controller provides data signals to the main pixel area and the secondary pixel area of the any one sub pixel unit through different data lines;

acquiring a grayscale value of a picture to be displayed of each of the partial sub pixel units;

searching for a main grayscale value and a secondary grayscale value corresponding to the grayscale value of the picture to be displayed of the each of the partial sub pixel units from a corresponding relationship between the grayscale value of a color of each of the partial sub pixel units and the main grayscale value and the secondary grayscale value; and providing the searched main grayscale value and the secondary grayscale value to the main pixel area and the secondary pixel area of the each of the partial sub pixel units respectively;

wherein the corresponding relationship between the grayscale value of each of the colors and the main grayscale value and the secondary grayscale value satisfies the following conditions: in an order of magnitudes of the grayscale value of any one color from the plurality of colors, respectively providing the main grayscale value and the secondary grayscale value corresponding to the grayscale value to the main pixel area and the secondary pixel area of the sub pixel unit of the any one color among the partial sub pixel units in sequence, and a relation curve graph between the grayscale value and luminance of the sub pixel unit of the any one color at a slant angle (β) is same as or similar to a predetermined gamma (γ) curve; and wherein the corresponding relationship between the grayscale value of the any one color and the main grayscale value and the secondary grayscale value is acquired from the following steps:

S101, acquiring an actual luminance value Lvα of each grayscale G of a sub pixel unit of the any one color of the liquid crystal panel at a front view angle (α);

S102, acquiring an actual luminance value Lvβ of each grayscale G of the sub pixel unit of the any one color of the liquid crystal panel at the slant view angle (β);

S103, according to an area ratio of a:b of the main pixel area and the secondary pixel area of the sub pixel unit of the any one color, dividing the actual luminance value Lvα into actual values LvMα and LvSα of each grayscale G of the main pixel area and the secondary pixel area at the front view angle (α), dividing the actual luminance value Lvβ into actual values LvMβ and LvSβ of each grayscale G of the main pixel area and the secondary pixel area at the slant view angle (β) according to the following equations:

$$LvM\alpha: LvS\alpha=a:b,\ LvM\alpha+LvS\alpha=Lv\alpha;$$

$$LvM\beta: LvS\beta=a:b,\ LvM\beta+LvS\beta=Lv\beta;$$

S104: calculating theoretical luminance values LvGxα and LvGxβ of the grayscale G of the sub pixel unit of the any one color of the liquid crystal panel at the front view angle (α) and the slant angle (β) according to the actual luminance values Lvα(max) and Lvβ(max) of a highest grayscale max acquired in steps S101 and S102, in conjunction with an equation of the predetermined gamma (γ) curve and $$\left(\frac{G}{\max}\right)^{\gamma}=\frac{LvG}{Lv(\max)};$$

S105, determining the main grayscale value and the secondary value corresponding to each of the grayscale value of the any one color, wherein, as for any one grayscale value Gx, following equations are calculated according to the actual luminance values LvMα, LvMβ, LvSα and LvSβ obtained in the result of the above step S103 and the theoretical luminance values LvGxα and LvGxβ obtained in the result of the above step S104:

$$\Delta1=LvM\alpha+LvS\alpha-LvGx\alpha;\ \Delta2=LvM\beta+LvS\beta-LvGx\beta;$$
$$y=\Delta1^2+\Delta2^2;\text{ and}$$

when y is minimal, corresponding grayscale values Gmx and Gsx are set to be the main grayscale value and the secondary grayscale value corresponding to the any one grayscale value Gx.

7. The method of driving the liquid crystal panel of claim 6, wherein the step S101 further comprises:

measuring the gamma (γ) curve of the sub pixel unit of the any one color at the front view angle (α) directly; and determining the actual luminance value Lvα according to the gamma (γ) curve.

8. The method of driving the liquid crystal panel of claim 6, wherein the step S102 further comprises:

measuring the gamma (γ) curve of the sub pixel unit of the any one color at the slant view angle (β) directly; and determining the actual luminance value Lvβ according to the gamma (γ) curve.

9. The method of driving the liquid crystal panel of claim 6, wherein the front view angle (α) is 0°, and the slant angle (β) is 30°-80°.

* * * * *